US010955107B1

(12) United States Patent
Toyoshima et al.

(10) Patent No.: US 10,955,107 B1
(45) Date of Patent: Mar. 23, 2021

(54) VEHICLE HEADLIGHT

(71) Applicant: KOITO MANUFACTURING CO., LTD., Tokyo (JP)

(72) Inventors: Takanobu Toyoshima, Shizuoka (JP); Naoki Sugiura, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/635,661

(22) PCT Filed: Jul. 13, 2018

(86) PCT No.: PCT/JP2018/026530
§ 371 (c)(1),
(2) Date: Jan. 31, 2020

(87) PCT Pub. No.: WO2019/031160
PCT Pub. Date: Feb. 14, 2019

(30) Foreign Application Priority Data

Aug. 9, 2017 (JP) ..... JP2017-154221

(51) Int. Cl.
*F21S 41/64* (2018.01)
*F21S 41/33* (2018.01)
(Continued)

(52) U.S. Cl.
CPC ..... *F21S 41/645* (2018.01); *F21S 41/135* (2018.01); *F21S 41/148* (2018.01); *F21S 41/285* (2018.01); *F21S 41/33* (2018.01)

(58) Field of Classification Search
CPC ..... F21S 41/135; F21S 41/148; F21S 41/285; F21S 41/33; F21S 41/645
(Continued)

(56) References Cited

U.S. PATENT DOCUMENTS

2017/0276980 A1 9/2017 Kauschke et al.

FOREIGN PATENT DOCUMENTS

DE 102014113700 A1 3/2016
JP H05-066476 A 3/1993
(Continued)

OTHER PUBLICATIONS

International Search Report dated Oct. 2, 2018 filed in PCT/JP2018/026530.

*Primary Examiner* — Jason M Han
(74) *Attorney, Agent, or Firm* — Pearne & Gordon LLP

(57) ABSTRACT

The present invention relates to a vehicle headlight that ensures improving usage efficiency of light focusing of light emitted from a light source. A vehicle headlight (1) has a main reflecting mirror (10) having an elliptic main reflecting surface (10*a*) and a light source (8) positioned at a first focal point (F1) of the main reflecting surface (10) and disposed opposed to the main reflecting surface (10). The vehicle headlight includes a reflection type polarizing plate (13) disposed between the main reflecting mirror (10) and a second focal point (F2) of the main reflecting mirror (10), an auxiliary reflecting mirror (11) that is disposed opposed to the reflection type polarizing plate (13) and reflects reflected polarized light (B12) by the reflection type polarizing plate (13) again to focus the reflected polarized light at the second focal point (F2) of the main reflecting surface (10), and a quarter-wave plate (14) that is disposed between the reflection type polarizing plate (13) and the auxiliary reflecting mirror (11) and disposed between the auxiliary reflecting mirror (11) and the second focal point (F2) of the main reflecting mirror (10).

4 Claims, 4 Drawing Sheets

(51) Int. Cl.
*F21S 41/20* (2018.01)
*F21S 41/148* (2018.01)
*F21S 41/135* (2018.01)

(58) Field of Classification Search
USPC ..... 362/520–521
See application file for complete search history.

(56) References Cited

FOREIGN PATENT DOCUMENTS

| | | | |
|---|---|---|---|
| JP | H05-072417 | A | 3/1993 |
| JP | H09-160126 | A | 6/1997 |
| JP | 2011-249184 | A | 12/2011 |
| JP | 2014-222567 | A | 11/2014 |

VEHICLE HEADLIGHT

TECHNICAL FIELD

The present invention relates to a vehicle headlight that improves usage efficiency of light focusing of light emitted from a light source.

BACKGROUND ART

PATENT LITERATURE 1 discloses in FIG. 3 a vehicle headlight that reflects light emitted from a light source by a reflector so as to forms a light focusing ahead, and have reflected light transmitted through a liquid crystal plate (liquid crystal shutter) disposed adjacent to the focal point and a projection lens ahead of the liquid crystal plate to indicate a light distribution pattern. The liquid crystal plate generally does not allow either one of P-polarized light or S-polarized light of light to be transmitted depending on its property. This causes a problem in that only a half of the light is available.

Meanwhile, PATENT LITERATURE 2 discloses in FIG. 1 a polarized light conversion element that ensures improving usage efficiency of the light used for the liquid crystal plate by separating the light into the S-polarized light and the P-polarized light with a polarized light separation surface as a reflection type polarizing plate, reflecting the one reflected polarized light (P-polarized light in this case) again with a reflective element of a light flux, and having the re-reflected light transmitted through a half-wave plate only once, that is, at an odd number of times, to match the one reflected polarized light (P-polarized light) with the other polarized light (S-polarized light in this case).

CITATION LIST

Patent Literature

PATENT LITERATURE 1: JP-A-2011-249184
PATENT LITERATURE 2: JP-A-5-72417

SUMMARY OF THE INVENTION

Problems to be Solved by the Invention

In general, the vehicle headlight, such as PATENT LITERATURE 1, is expected to form a hot spot in the light distribution pattern by forming the light emitted from the light source to forms a focal point and having the focused light transmitted through the liquid crystal plate adjacent to the focal point. The vehicle headlight is also expected to form a clear cut off-line by causing the focused light to pass through a shade disposed adjacent to the focal point.

However, when the polarized light conversion element of PATENT LITERATURE 2 is disposed between the reflector and the focal point of the reflector in the vehicle headlight of PATENT LITERATURE 1, the polarized light transmitted through the polarized light separation surface keeps focusing at the focal point but the polarized light reflected by the polarized light separation surface cannot focus at the focal point in common with the polarized light transmitted through the polarized light separation surface. Thus, this causes a problem in that even when the polarized light reflected by the polarized light separation surface is matched with the transmitted polarized light, a reflected polarized light component does not contribute to a formation of the hot spot in the light distribution pattern and a formation of the clear cut-off line.

This application has been made in consideration of the above-described problem, and provides the vehicle headlight that ensures improving the usage efficiency of the light focusing of the light emitted from the light source.

Solution to the Problems

A vehicle headlight having a main reflecting mirror having an elliptic main reflecting surface and a light source, the light source being positioned at a first focal point of the main reflecting surface and disposed opposed to the main reflecting surface, the vehicle headlight including: a reflection type polarizing plate disposed between the main reflecting mirror and a second focal point of the main reflecting mirror; an auxiliary reflecting mirror that is disposed opposed to the reflection type polarizing plate and reflects reflected polarized light by the reflection type polarizing plate again to focus the reflected polarized light at the second focal point of the main reflecting surface; and a quarter-wave plate that is disposed between the reflection type polarizing plate and the auxiliary reflecting mirror and disposed between the auxiliary reflecting mirror and the second focal point of the main reflecting mirror.

(Operation) Light transmitted through the reflection type polarizing plate focuses ahead at a focal point. Polarized light reflected by the reflection type polarizing plate is reflected again by the auxiliary reflecting mirror after passing through the quarter-wave plate so as to focus at the same focal point at which polarized light transmitted through the reflection type polarizing plate focuses. Additionally, the re-reflected polarized light passes through the quarter-wave plate again before focusing at the focal point to match a polarized light direction with the transmitted polarized light.

In the vehicle headlight, the quarter-wave plate is disposed on an auxiliary reflecting surface of the auxiliary reflecting mirror.

(Operation) Without having a special arrangement space in a lamp space of the vehicle headlight, the quarter-wave plate is disposed at a position where reflected light by a main reflecting mirror is not disturbed.

In the vehicle headlight, a second auxiliary reflecting mirror is disposed between the reflection type polarizing plate and the auxiliary reflecting mirror.

(Operation) The polarized light reflected by the reflection type polarizing plate is reflected by the second auxiliary reflecting mirror to enter the auxiliary reflecting mirror.

In the vehicle headlight, a liquid crystal plate is disposed adjacent to the second focal point of the main reflecting mirror.

(Operation) Both the polarized light transmitted through the reflection type polarizing plate and the polarized light reflected by the reflection type polarizing plate pass through the liquid crystal plate in a state of being focused.

Effects of the Invention

With the vehicle headlight, even when passing through the wave plate at an even number of times, the polarized light reflected by the reflection type polarizing plate matches the polarized light direction with the polarized light transmitted through the reflection type polarizing plate to ensure focusing at the same focal point. The light reflected by the reflection type polarizing plate and having the polarized light direction unified by the wave plate can be all used to form a hot spot in the light distribution pattern and a clear cut-off line, and thus usage efficiency of a light focusing of the light emitted from the light source improves.

Additionally, eliminating the need for the special arrangement space for the quarter-wave plate allows for downsizing the vehicle headlight.

Additionally, since the polarized light reflected by the reflection type polarizing plate is entered via a second reflecting mirror, a flexibility of positioning of the auxiliary reflecting mirror improves.

Additionally, the polarized light reflected by the reflection type polarizing plate passes through the liquid crystal plate together with the polarized light transmitted through the reflection type polarizing plate to contribute to a formation of the hot spot of the light distribution pattern.

DESCRIPTION OF THE EMBODIMENTS

The following describes preferred embodiments of the present invention based on FIGS. 1 to 4. In each drawing, directions of respective units of a vehicle headlight and a road viewed from a driver of a vehicle to which the vehicle headlight is mounted are described as (upper: lower: left: right: front: rear=Up: Lo: Le: Ri: Fr: Re).

Figure 1:
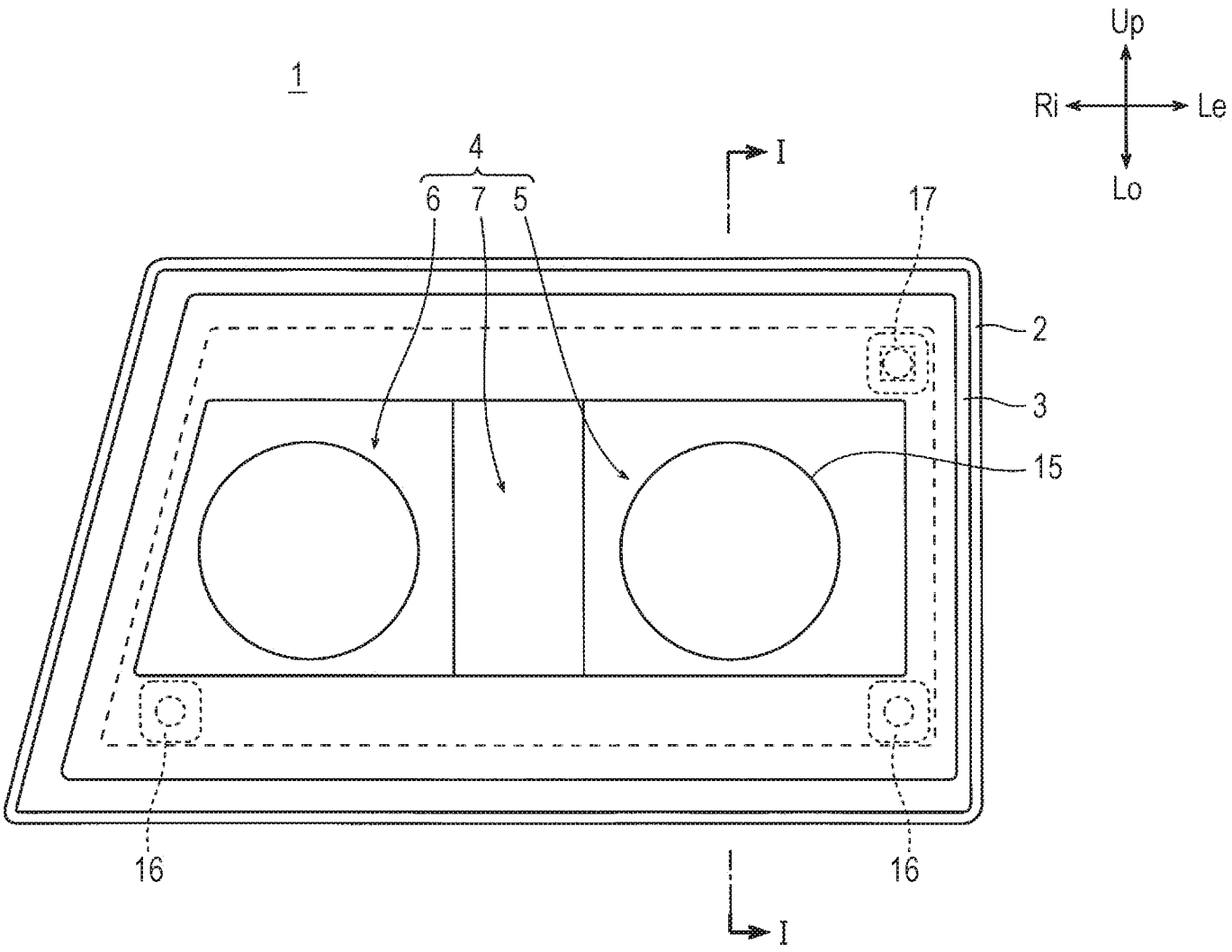
FIG. 1 is a front view of a vehicle headlight according to a first example.
Figure 2:
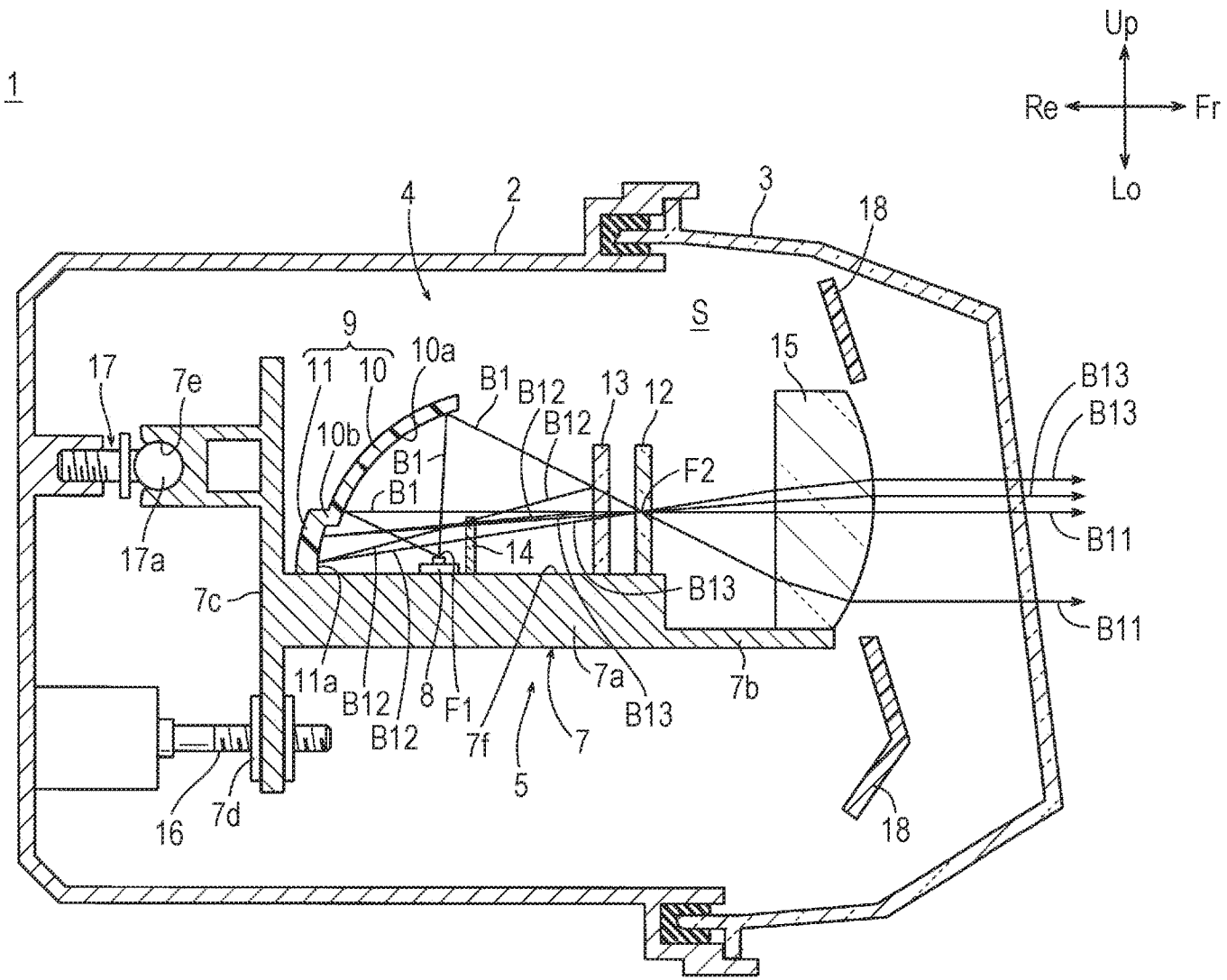
FIG. 2 is a I-I cross-sectional view of FIG. 1 taken along a vertical direction of a lighting unit for a high beam of the vehicle headlight according to the first example.

According to FIGS. 1 and 2, a vehicle headlight of a first example is described. A vehicle headlight 1 of the first example includes a lamp body 2, a front cover 3, and a headlight unit 4. The lamp body 2 has an opening on a front side of a vehicle. The front cover 3 is formed of a resin, a glass, and the like that have a translucency, and is installed to the opening of the lamp body 2 to form a lamp space S inside. The headlight unit 4 illustrated in FIG. 1 is configured by integrating a high beam headlight unit 5 and a low beam headlight unit 6 with a metallic supporting member 7, and disposed inside the lamp space S.

The high beam headlight unit 5 and the low beam headlight unit 6 each have a light source 8, a reflecting mirror 9 having a main reflecting mirror 10 and an auxiliary reflecting mirror 11, a liquid crystal plate 12, a reflection type polarizing plate 13, a quarter-wave plate 14, and a projection lens 15, as illustrated in FIG. 2. These are all installed to the supporting member 7.

The supporting member 7 in FIG. 2 is formed of metal, and has a light source supporting portion 7*a*, a lens supporting portion 7*b* at a front end of the light source supporting portion 7*a*, and a base plate portion 7*c* integrated with a base end of the light source supporting portion 7*a*. The base plate portion 7*c* has screw fixing portions (7*d*, one on a right side is not illustrated) at two portions on the right and left, and a sphere receiving portion 7*e* for them integrally. The light source 8 is formed of a light-emitting element, such as an LED. The reflecting mirror 9 has the main reflecting mirror 10, which has a main reflecting surface 10*a* in a spheroidal surface shape, and the auxiliary reflecting mirror 11, which has an auxiliary reflecting surface 11*a* in a free-form surface shape. The auxiliary reflecting mirror 11 is integrally formed with a lower end portion 10*b* of the main reflecting mirror, and the auxiliary reflecting surface 11*a* is formed such that received light is reflected to focus at a second focal point F2 of the main reflecting surface 10*a*.

The light source 8 in FIG. 2 is fixed on the light source supporting portion 7*a*, and the reflecting mirror 9 is fixed to an upper surface 7*f* of the light source supporting portion 7*a* such that the light source 8 is disposed at a proximity of a first focal point F1 of the main reflecting surface 10*a*, which has the main reflecting surface and the spheroidal surface shape. The liquid crystal plate 12 is fixed to the upper surface 7*f* of the light source supporting portion 7*a* so as to be positioned at the second focal point F2 of the main reflecting surface 10*a* of the main reflecting mirror 10. The reflection type polarizing plate 13 is a member that has one of S-polarized light or P-polarized light of light transmitted and reflects the other. The reflection type polarizing plate 13 is fixed to the upper surface 7*f* of the light source supporting portion 7*a* so as to be disposed between the main reflecting surface 10*a* of the main reflecting mirror 10 and the second focal point F2 of the main reflecting surface 10*a*, ahead of the light source 8 and the reflecting mirror 9. Note that in each example, a shade for forming a cut-off line may be disposed instead of the liquid crystal plate 12.

The quarter-wave plate 14 in FIG. 2 is a member that shifts a phase of the transmitted light by 90°. The quarter-wave plate 14 is fixed to the upper surface 7*f* of the light source supporting portion 7*a* so as to be disposed between the reflection type polarizing plate 13 and the auxiliary reflecting mirror 11 and disposed between the auxiliary reflecting mirror 11 and the second focal point F2 of the main reflecting surface 10*a*, ahead of the light source 8 and the reflecting mirror 9. The projection lens 15 is formed as a plano-convex lens that becomes convex to a front, and fixed to the lens supporting portion 7*b* ahead of the liquid crystal plate 12.

The headlight unit 4 including the supporting member 7 is tiltably supported with respect to the lamp body 2 by having aiming screws (16, one on the right side is not illustrated) screwed to the screw fixing portions (7*d*, one on the right side is not illustrated) of the base plate portion 7*c* respectively, and by being mounted with a ball 17*a* of a hitch ball 17 to the sphere receiving portion 7*e*. The aiming screws (16, the one on the right side is not illustrated) is turnably held onto the lamp body 2. The hitch ball 17 is screwed to the lamp body 2. Additionally, the lamp space S is provided inside with an extension reflector 18 screening a peripheral area of the projection lens 15 from the front.

Next, a description will be given of a state of light usage by the vehicle headlight 1 of the first example with reference to FIG. 2. Light B1 emitted from the light source 8 disposed adjacent to the first focal point F1 of the main reflecting surface 10*a* of the main reflecting mirror 10 is reflected toward the reflection type polarizing plate 13 ahead by the main reflecting surface 10*a* so as to focus at the second focal point F2. When the reflection type polarizing plate 13 is disposed in a state where only the S-polarized light can be transmitted, only S-polarized light B11 of the light B1 is transmitted through the reflection type polarizing plate 13. P-polarized light B12 of the light B1 cannot be transmitted through the reflection type polarizing plate 13 and is reflected toward the quarter-wave plate 14 and the auxiliary reflecting surface 11*a* of the auxiliary reflecting mirror 11. The S-polarized light B11 is transmitted through the liquid crystal plate 12 while focusing at the second focal point F2 of the main reflecting surface 10*a*, and is transmitted through the projection lens 15 and the front cover 3 ahead in sequence to be emitted forward.

The P-polarized light B12 in FIG. 2 has a phase shifted by 90° by being transmitted through the quarter-wave plate 14, and is reflected by the auxiliary reflecting surface 11*a* of the auxiliary reflecting mirror 11 so as to focus at the second focal point F2 ahead. The P-polarized light B12 reflected by the auxiliary reflecting surface 11*a* is transmitted through the quarter-wave plate again, has the phase shifted further by 90°, and turns S-polarized light B13. The S-polarized light B13 is transmitted through the reflection type polarizing plate 13, is transmitted through the liquid crystal plate 12 while focusing at the second focal point F2 of the main reflecting surface 10*a* of the main reflecting mirror 10, and is transmitted through the projection lens 15 and the front cover 3 ahead in sequence to be emitted forward.

The P-polarized light B12 reflected by the reflection type polarizing plate 13 in FIG. 2 is reflected by the auxiliary reflecting surface 11*a* of the auxiliary reflecting mirror 11 so as to focus at the second focal point F2. The P-polarized light B12 turns the S-polarized light B13 that can be transmitted through the reflection type polarizing plate 13 by being transmitted through the quarter-wave plate 14 twice in total until reaching the reflection type polarizing plate 13, and becomes light that focuses at the second focal point F2 in common with the S-polarized light B11 by the auxiliary reflecting mirror 11 to be emitted ahead of the front cover 3. The P-polarized light B12 turns the S-polarized light B13 by being transmitted through the quarter-wave plate 14 twice, and indicates a light distribution pattern for a high beam ahead of the vehicle (not illustrated) together with the S-polarized light B11.

Note that in this example, if the reflection type polarizing plate 13 is disposed in a state where only the P-polarized light can be transmitted, both polarized light that is reflected by the main reflecting mirror 10 and passes through the reflection type polarizing plate 13 and polarized light that is reflected by the reflection type polarizing plate 13, reflected again by the auxiliary reflecting mirror 11, and transmitted through the quarter-wave plate twice become the P-polarized lights. In any case, a polarized light component reflected by the reflection type polarizing plate 13 forms a combined light distribution pattern for the high beam by having a polarized light direction unified to the polarized light component transmitted through the reflection type polarizing plate.

The vehicle headlight 1 of this example causes the P-polarized light B12, which is reflected by the reflection type polarizing plate 13, to be transmitted through the wave plate so as to unify the polarized light direction with the transmitted S-polarized light B11 and focus it at the focal point in common with the S-polarized light B11. This contributes to a formation of the light distribution pattern without wasting the reflected polarized light.

The quarter-wave plate 14 of the first example illustrated in FIG. 2 is disposed, on the light source supporting portion 7*a* of the supporting member 7, on both an optical path of the P-polarized light B12 heading from the reflection type polarizing plate 13 to the auxiliary reflecting mirror 11 and an optical path of the P-polarized light B12 reflected again from the auxiliary reflecting mirror 11 toward the second focal point F2. The quarter-wave plate 14 is also disposed at a position off an optical path of the light B1 emitted from the light source 8 and reflected by the main reflecting mirror 10.

The quarter-wave plate 14 allows both the P-polarized light B12 heading from the reflection type polarizing plate 13 to the auxiliary reflecting mirror 11 and the P-polarized light B12 reflected again from the auxiliary reflecting mirror 11 toward the second focal point F2 to be transmitted back and forth when the P-polarized light is turned to the S-polarized light. Consequently, according to the vehicle headlight 1 of the first example, using the quarter-wave plate 14 allows the S-polarized light B13 varied from the P-polarized light B12 to be directly reflected by the auxiliary reflecting mirror 11 to focus at the second focal point F2 from the reflection type polarizing plate 13, to easily focus at the same focal point at which the S-polarized light B11 transmitted through the reflection type polarizing plate 13 focuses, and to be used by combining into the light distribution pattern with transmitted polarized light. This improves usage efficiency of light focusing of the light emitted from the light source.

Additionally, according to the vehicle headlight 1 of the first example, using the quarter-wave plate allows having a shortest optical path of the reflected polarized light reflected by the reflection type polarizing plate 13 and reaching the second focal point F2, and thus the vehicle headlight can be downsized.

If the vehicle headlight 1 such as the first example uses a half-wave plate instead of the quarter-wave plate to turn the P-polarized light B12 into the S-polarized light B13, the half-wave plate shifting a phase by 180° cannot turn the reflected P-polarized light B12 into the S-polarized light. This is because the phase returns the original when the reflected P-polarized light B12 passes through the half-wave plate back and forth. Therefore, the vehicle headlight employing the half-wave plate needs to divert one of the optical paths of the P-polarized light B12 traveling back and forth from the reflection type polarizing plate 13 toward the auxiliary reflecting mirror 11 and from the auxiliary reflecting mirror 11 toward the second focal point F2 such that the one of the P-polarized light B12 is not transmitted through the half-wave plate.

However, in order to divert the optical path, multiple auxiliary reflecting mirrors are necessary to reflect the light multiple times, and an extra space needs to be ensured to pass the diverted light through. This causes a problem in that the headlight unit 4 and the vehicle headlight increase in size. Additionally, the polarized light component via a complicated bypass route is limited in a direction of irradiation by being diverted, even passing through the second focal point F2 together with the S-polarized light B11. The polarized light component distributes light overlapping the light distribution pattern by the S-polarized light B11 less easily. This causes a problem in that flexibility of the combined light distribution pattern with the S-polarized light B11 possibly reduces.

According to the vehicle headlight 1 of the first example, employing the quarter-wave plate, not the half-wave plate, allows having the shortest optical path of a reflected polarized light component focused at the second focal point F2. This ensures simplifying and downsizing components of the headlight unit 4 and makes it easier to combine the light distribution pattern by the reflected polarized light component focused at the second focal point F2 with the light distribution pattern by a transmitted polarized light component. This ensures improving the flexibility of the combined light distribution pattern shape and improving the usage efficiency of the light focusing of the reflected polarized light component.

Next, a description will be given of a vehicle headlight 21 of a second example and a state of light usage according to the second example with reference to FIG. 3. The vehicle headlight 21 of the second example is provided with a quarter-wave plate 22 instead of the quarter-wave plate 14, as well as having a configuration in common with the vehicle headlight 1 of the first example.

Specifically, the quarter-wave plate 22 of the second example is disposed overlapping on the auxiliary reflecting surface 11*a* of the auxiliary reflecting mirror 11, not on the light source supporting portion 7*a* ahead of the light source 8. When the reflection type polarizing plate 13 is disposed to allow only the S-polarized light to be transmitted, light B2 emitted from the light source 8 has S-polarized light B21 transmitted toward the second focal point F2 and has P-polarized light B22 reflected toward the auxiliary reflecting mirror 11. Providing the quarter-wave plate on the auxiliary reflecting surface 11*a* allows the P-polarized light B22 reflected from the reflection type polarizing plate 13 toward the auxiliary reflecting mirror 11 to turn S-polarized light B23 by being transmitted through the quarter-wave plate 22 back and forth when reflected by the auxiliary reflecting surface 11*a*. The S-polarized light B23 reflected by the auxiliary reflecting surface 11*a* focuses at the second focal point F2 in common with the S-polarized light B21. The S-polarized light B23 is transmitted through the liquid crystal plate 12, the projection lens 15, and the front cover 3, and emitted ahead of the vehicle (not illustrated) together with the S-polarized light B21 to form the combined light distribution pattern.

Figure 3:
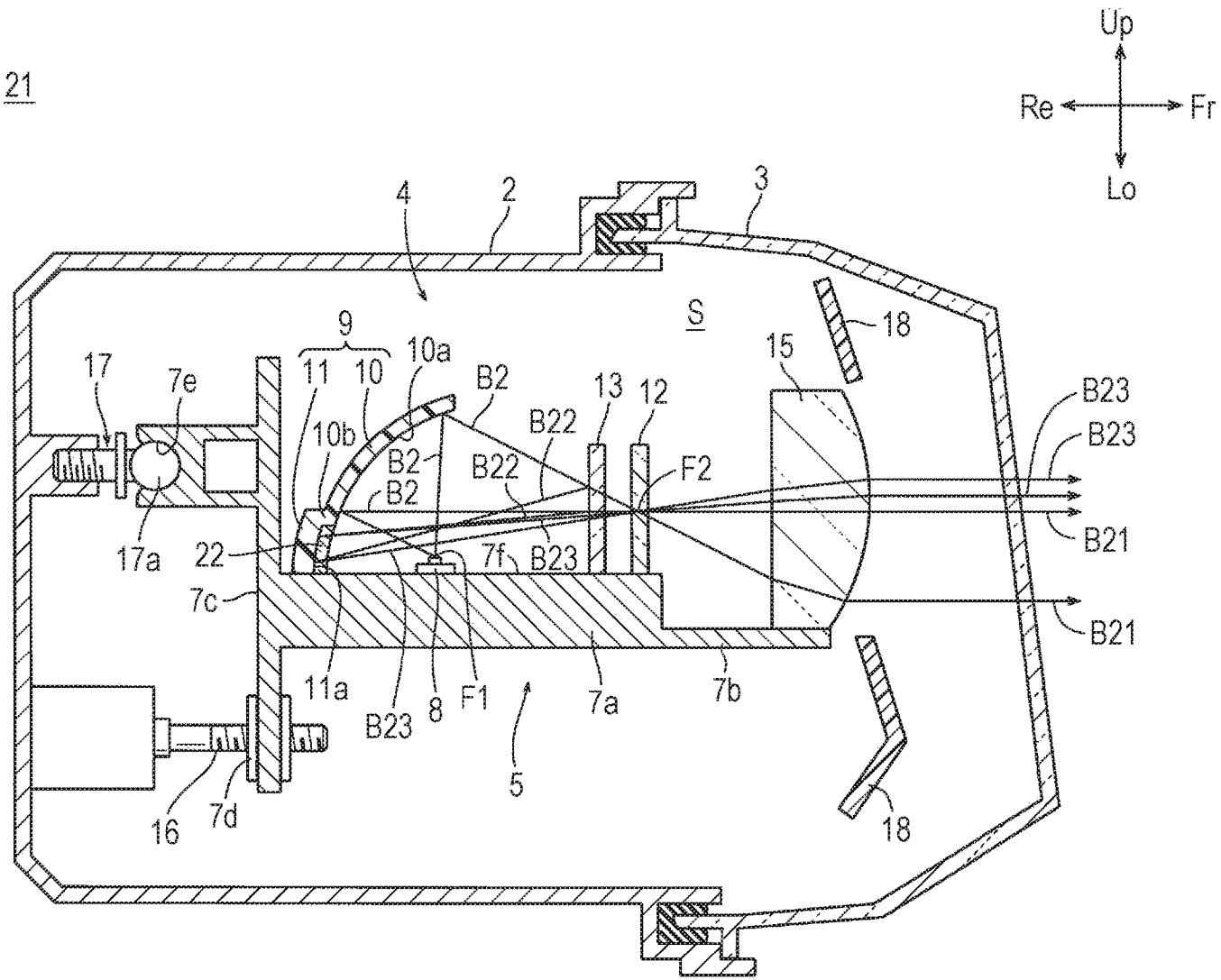
FIG. 3 is a vertical cross-sectional view of a lighting unit for a high beam of a vehicle headlight according to a second example.

The vehicle headlight 21 of the second example in FIG. 3 has an advantage in that a phase shift by causing the light B2 emitted from the light source 8 to be mistakenly transmitted is less likely to happen by positioning the quarter-wave plate 22 on the auxiliary reflecting surface 11*a* of the auxiliary reflecting mirror 11, not opposed to the light source 8.

Next, a description will be given of a vehicle headlight 31 of a third example and a state of light usage according to the third example with reference to FIG. 4. The vehicle headlight 31 of the third example has a supporting member 7' having a second auxiliary reflecting mirror 32 instead of the supporting member 7 of the first example, as well as having a configuration in common with the vehicle headlight 1 of the first example. Additionally, the supporting member 7' has the second auxiliary reflecting mirror 32 formed on the light source supporting portion 7*a*, as well as having a configuration in common with the supporting member 7 of the first example.

Figure 4:
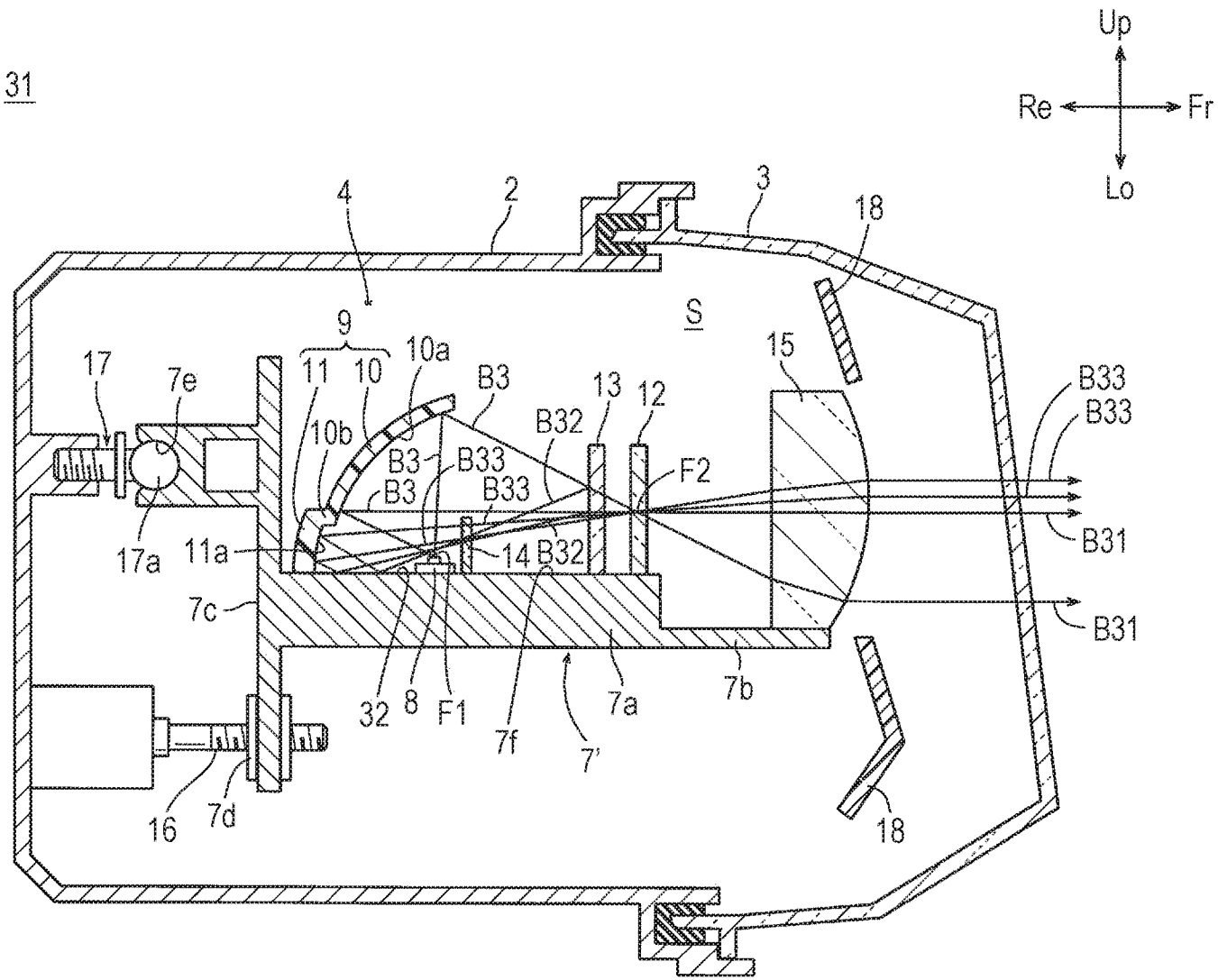
FIG. 4 is a vertical cross-sectional view of a lighting unit for a high beam of a vehicle headlight according to a third example.

The second auxiliary reflecting mirror 32 in FIG. 4 is formed by performing mirror surface treatment, such as silver vapor deposition, on a part of an area of the upper surface 7*f* of the light source supporting portion 7*a*, that is, an area from a rear of the light source 8 to a front of the auxiliary reflecting surface 11*a* of the auxiliary reflecting mirror 11.

When the reflection type polarizing plate 13 is disposed to allow only the S-polarized light to be transmitted, light B3 emitted from the light source 8 positioned at the first focal point F1 of the main reflecting mirror 10 has S-polarized light B31 transmitted toward the second focal point F2 and has P-polarized light B32 reflected toward the second auxiliary reflecting mirror 32. The P-polarized light B32 is transmitted through the quarter-wave plate 14 to have a phase shifted by 90°, and is reflected toward the auxiliary reflecting surface 11*a* of the auxiliary reflecting mirror 11 by the second auxiliary reflecting mirror 32. The P-polarized light B32 is reflected by the auxiliary reflecting surface 11*a* so as to focus toward the second focal point F2 in common with the S-polarized light B31, and turns S-polarized light B33 by passing through the quarter-wave plate again to have the phase further shifted by 90°. The S-polarized light B33 is transmitted through the reflection type polarizing plate 13, and focuses at the second focal point F2 together with the S-polarized light B31, while being transmitted through the liquid crystal plate 12, the projection lens 15, and the front cover 3, and indicating the combined light distribution pattern ahead of the vehicle (not illustrated) together with the S-polarized light B31.

With the vehicle headlight 31 of the third example in FIG. 4, the P-polarized light B32 reflected by the reflection type polarizing plate 13 is reflected again to the auxiliary reflecting mirror 11 via the second auxiliary reflecting mirror 32. Thus, the reflected P-polarized light B32 is easily reflected to focus at the second focal point F2 even if the auxiliary reflecting mirror 11 is disposed at another position. That is, the vehicle headlight 31 of the third example can improve a degree of freedom in an installation position of the auxiliary reflecting mirror 11, while causing the S-polarized light B33 to focus at the second focal point F2 in common with the S-polarized light B31, and forming the light distribution pattern with high degree of freedom by the S-polarized lights (B31, B33).

This application claims priority from Japanese Patent Application No. 2017-154221 filed with the Japanese Patent Office on Aug. 9, 2017, the entire contents of which are hereby incorporated by reference.

The above description of a specific embodiment of the present invention is disclosed as illustrative. This does not intend to be exhaustive or limit the present invention to the described embodiments as they are. Many modifications and variations will be apparent to one of ordinary skill in the art in light of the above teachings.

LIST OF REFERENCE NUMERALS

1: Vehicle headlight
8: Light source
10: Main reflecting mirror
10*a*: Main reflecting surface
11: Auxiliary reflecting mirror
11*a*: Auxiliary reflecting surface
13: Reflection type polarizing plate
14: Quarter-wave plate
21: Vehicle headlight
22: Quarter-wave plate
32: Second auxiliary reflecting mirror
14*a*: Reflecting surface
F1: First focal point
F2: Second focal point

What is claimed is:

1. A vehicle headlight having a main reflecting mirror having an elliptic main reflecting surface and a light source, the light source being positioned at a first focal point of the main reflecting surface and disposed opposed to the main reflecting surface, the vehicle headlight comprising:

a reflection type polarizing plate disposed between the main reflecting mirror and a second focal point of the main reflecting mirror;

an auxiliary reflecting mirror that is disposed opposed to the reflection type polarizing plate and reflects reflected polarized light by the reflection type polarizing plate again to focus the reflected polarized light at the second focal point of the main reflecting surface; and a quarter-wave plate that is disposed between the reflection type polarizing plate and the auxiliary reflecting mirror and disposed between the auxiliary reflecting mirror and the second focal point of the main reflecting mirror.

2. The vehicle headlight according to claim 1, wherein the quarter-wave plate is disposed on an auxiliary reflecting surface of the auxiliary reflecting mirror.

3. The vehicle headlight according to claim 1, further comprising a second auxiliary reflecting mirror disposed between the reflection type polarizing plate and the auxiliary reflecting mirror.

4. The vehicle headlight according to claim 1, further comprising a liquid crystal plate disposed adjacent to the second focal point of the main reflecting mirror.

* * * * *